US010133293B2

(12) United States Patent
Link et al.

(10) Patent No.: US 10,133,293 B2
(45) Date of Patent: Nov. 20, 2018

(54) LOW SUPPLY ACTIVE CURRENT MIRROR

(71) Applicant: Avnera Corporation, Beaverton, OR (US)

(72) Inventors: Garry N. Link, Pacific City, OR (US); Wai Lee, Portland, OR (US)

(73) Assignee: Avnera Corporation, Beaverton, OR (US)

( * ) Notice: Subject to any disclaimer, the term of this patent is extended or adjusted under 35 U.S.C. 154(b) by 0 days.

(21) Appl. No.: 15/852,757

(22) Filed: Dec. 22, 2017

(65) Prior Publication Data

US 2018/0181157 A1 Jun. 28, 2018

Related U.S. Application Data

(60) Provisional application No. 62/438,928, filed on Dec. 23, 2016, provisional application No. 62/508,271, filed on May 18, 2017.

(51) Int. Cl.

| | |
|---|---|
| ***G05F 3/26*** | (2006.01) |
| ***G05F 1/10*** | (2006.01) |
| *G05F 3/02* | (2006.01) |

(52) U.S. Cl.

CPC ..... *G05F 3/262* (2013.01); *G05F 1/10* (2013.01); *G05F 3/02* (2013.01); *G05F 3/26* (2013.01)

(58) Field of Classification Search

CPC ... G05F 1/10; G05F 1/625; G05F 1/46; G05F 1/466; G05F 1/461; G05F 1/56; G05F 1/59; G05F 1/618; G05F 3/02; G05F 3/08; G05F 3/16; G05F 3/26; G05F 3/262; G05F 3/265; G05F 3/267

See application file for complete search history.

(56) References Cited

U.S. PATENT DOCUMENTS

| | | | | |
|---|---|---|---|---|
| 6,433,528 | B1 * | 8/2002 | Bonelli | G05F 3/262 323/314 |
| 6,492,796 | B1 * | 12/2002 | Morley | G05F 3/262 323/316 |
| 6,642,791 | B1 * | 11/2003 | Balan | H03F 3/45183 330/253 |
| 2004/0008096 | A1 * | 1/2004 | Liu | H03H 11/485 333/214 |
| 2004/0239304 | A1 * | 12/2004 | Perez | G05F 1/575 323/316 |
| 2007/0030050 | A1 * | 2/2007 | Lee | G05F 3/30 327/513 |
| 2010/0201406 | A1 * | 8/2010 | Illegems | G05F 3/242 327/109 |
| 2016/0342172 | A1 * | 11/2016 | Bai | G05F 3/267 |

* cited by examiner

*Primary Examiner* — Gustavo Rosario Benitez

(74) *Attorney, Agent, or Firm* — Knobbe, Martens, Olson & Bear, LLP

(57) ABSTRACT

A circuit can have a low mirror input voltage and fast settling while providing a large current mirror gain. The circuit can include a current source, a first current mirror device having a first transistor and a second transistor and electrically coupled with the current source, a third transistor electrically coupled with the first transistor, a second current mirror device having a fourth transistor and a fifth transistor and electrically coupled between the third transistor and the second transistor, and an output device electrically coupled with the first and second current mirror devices.

16 Claims, 4 Drawing Sheets

LOW SUPPLY ACTIVE CURRENT MIRROR

CROSS-REFERENCE TO RELATED APPLICATIONS

This application claims the benefit of U.S. Provisional Patent Application No. 62/438,928, filed Dec. 23, 2016, entitled "LOW SUPPLY ACTIVE CURRENT MIRROR," and U.S. Provisional Patent Application No. 62/508,271, filed May 18, 2017, entitled "LOW SUPPLY ACTIVE CURRENT MIRROR," the disclosures of both of which are incorporated herein by reference in their entirety.

TECHNICAL FIELD

This disclosure is directed to circuit designs including a current mirror in which a small current reference can be mirrored to a large bias current that can be dynamically switched on and off.

BACKGROUND

In general, current mirrors are circuits that are designed to "copy" a current driven through a first active device, such as a transistor, by controlling the current in a second active device, such as another transistor. Such circuits generally keep the output current constant regardless of loading. The "copied" current may be a varying signal current. Typical current mirrors may include a current amplifier which boosts the available drive current to an output device. Current mirrors are often used to provide bias currents and active loads to output devices.

FIG. 1 illustrates a first example of a circuit 100 that implements a prior current mirror having an input portion 101 and an output device 160. A current source 105 is electrically coupled with the input portion 101 of the current mirror which creates gate volte for the output device 160, which includes, for example, a first transistor 110 that has a gate 112, a drain 114, and a source 116 that is electrically coupled to ground. In the example, the output device 160 is a second transistor 160 that has a gate 162, a drain 164, and a source 166 that is electrically coupled to ground.

The gates 112 and 162 of the first and second transistors 110 and 160, respectively, are electrically coupled with each other. Either or both of the first and second transistors 110 and 160 may be each transistor may be a metal-oxide-semiconductor, field-effect transistor (MOSFET). The input supply voltage to the circuit 100 is $V_{dd}$, the voltage of the input of the current mirror at the drain 114 of the first transistor 110 is $V_{gs}$, and the output voltage at the drain 164 of the second transistor 160 is $V_{load}$. However, in situations where the input device is a 1 uA diode connected input device and the output device has up to 200 uA, for example, the circuit 100 is too slow for use where there is a need to settle bias currents in a 40 ns clock cycle.

FIG. 2 illustrates a second example of a circuit 200 that implements a prior current mirror that includes an input portion 201 and an output device 260. A current source 205 is electrically coupled with the input portion 201 of the current mirror which creates gate volte for the output 260. The input portion 201 includes three transistors 210, 220, and 230. The first transistor 210 has a gate 212, a drain 214, and a source 216 that is electrically coupled to ground. The second transistor 220 has a gate 222, a drain 224, and a source 226 that is electrically coupled to ground.

The third transistor 230 has a gate 232, a drain 234, and a source 236 that is electrically coupled with the gate 212 of the first transistor 210 as well as the gate 222 and drain 224 of the second transistor 220. The gate 232 of the third transistor 230 is electrically coupled with the drain 214 of the first transistor 210.

The circuit 200 also includes an output device such as, for example, a fourth transistor 260 that has a gate 262, a drain 264, and a source 266 that is electrically coupled to ground. The gates 212 and 262 of the first and fourth transistors 210 and 260, respectively, are electrically coupled with each other. The input voltage to the circuit 200 is $V_{dd}$, the voltage of the input of the current mirror at the drain 214 of the first transistor 210 is $V_{gs}$ of the second transistor 220 plus $V_{gs}$ of the third transistor 230, and the output voltage at the drain 264 of the fourth transistor 260 is $V_{load}$.

This circuitry arrangement is problematic in that there is minimal headroom at the drain 214 of the first transistor 210. In this circuit 200, the third transistor 230 is a source follower, also referred to herein as a current amplifier, and the second transistor 220 is a bias device for the source follower. Inclusion of the amplifier device 230 improves the current drive capability for better settling.

Thus, there remains a need for improved circuit designs that implement a current mirror.

DETAILED DESCRIPTION

Figure 3:
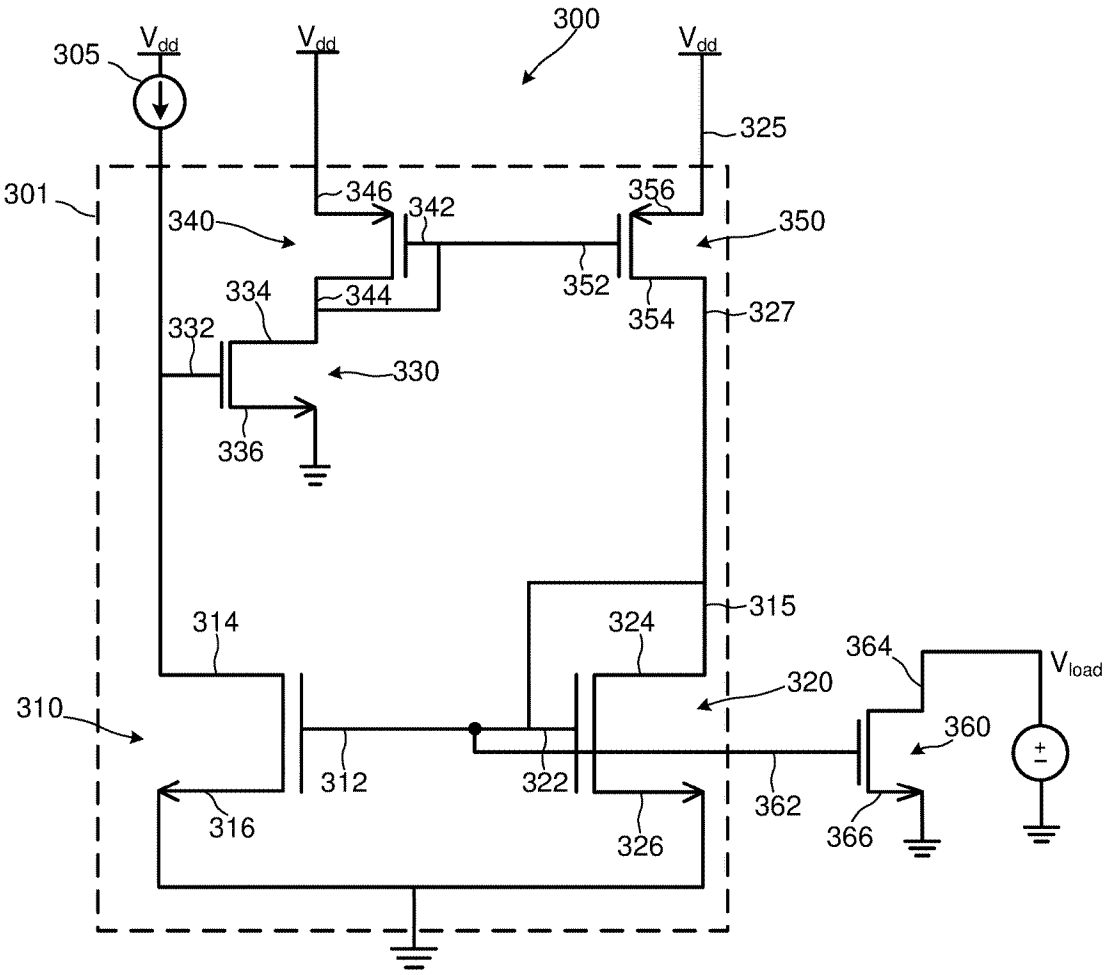
FIG. 3 is a circuit diagram illustrating a first example of a circuit implementing a current mirror in accordance with certain embodiments of the disclosed technology.

FIG. 3 illustrates a first example of a circuit 300 implementing a current mirror having an input portion 301 and an output device 360 in accordance with certain embodiments of the disclosed technology. A current source 305 is electrically coupled with the current mirror input portion 301, which includes five transistors 310, 320, 330, 340, and 350. Any or all of the transistors 310, 320, 330, 340, and 350 may be a metal-oxide-semiconductor, field-effect transistor (MOSFET), for example.

The first transistor 310 has a gate 312, a drain 314 that is electrically coupled with the current source 305, and a source 316 that is electrically coupled to ground. The second transistor 320 has a gate 322, a drain 324, and a source 326 that is electrically coupled to ground. The third transistor 330 has a gate 332 that is electrically coupled with the current source 305, a drain 334, and a source 336 that is electrically coupled to ground. In the example, the third transistor 330 is a common source amplifier that effectively serves as a boost device, e.g., 1 uA, and the second transistor 320 effectively serves as a bias for the third transistor 330.

In the example, the current mirror input portion 301 also includes a fourth transistor 340 that has a gate 342, a source 344 that is electrically coupled with the drain 334 of the third transistor 330, a source 346 that is electrically coupled with $V_{dd}$, a drain 344, and a fifth transistor 350 that has a gate 352 that is electrically coupled with the gate 342 and drain 344 of the fourth transistor 310, a drain 354 that is electrically coupled with the gate 322 and drain 324 of the second transistor 320, and a source 356 that is electrically coupled with $V_{dd}$.

The gates 342 and 352 of the fourth and fifth transistors 340 and 350, respectively, are electrically coupled with each other as well as the drains 334 and 344 of the third and fourth transistors 330 and 340, respectively. In the example, the fourth and fifth transistors 340 and 350 effectively serve as a current mirror, e.g., to mirror the boost current from the third transistor 330.

Figure 1:
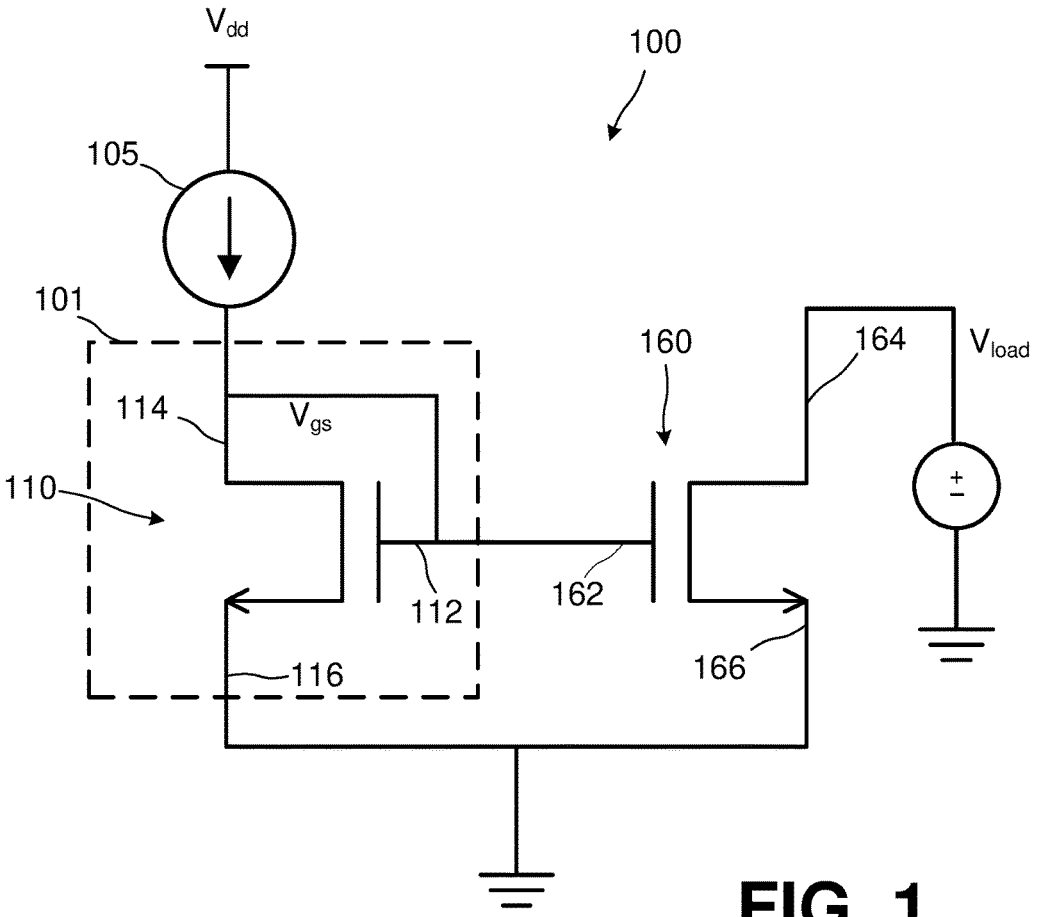
FIG. 1 Prior Art
FIG. 1 is a circuit diagram illustrating a first example of a circuit that implements a prior current mirror.
Figure 2:
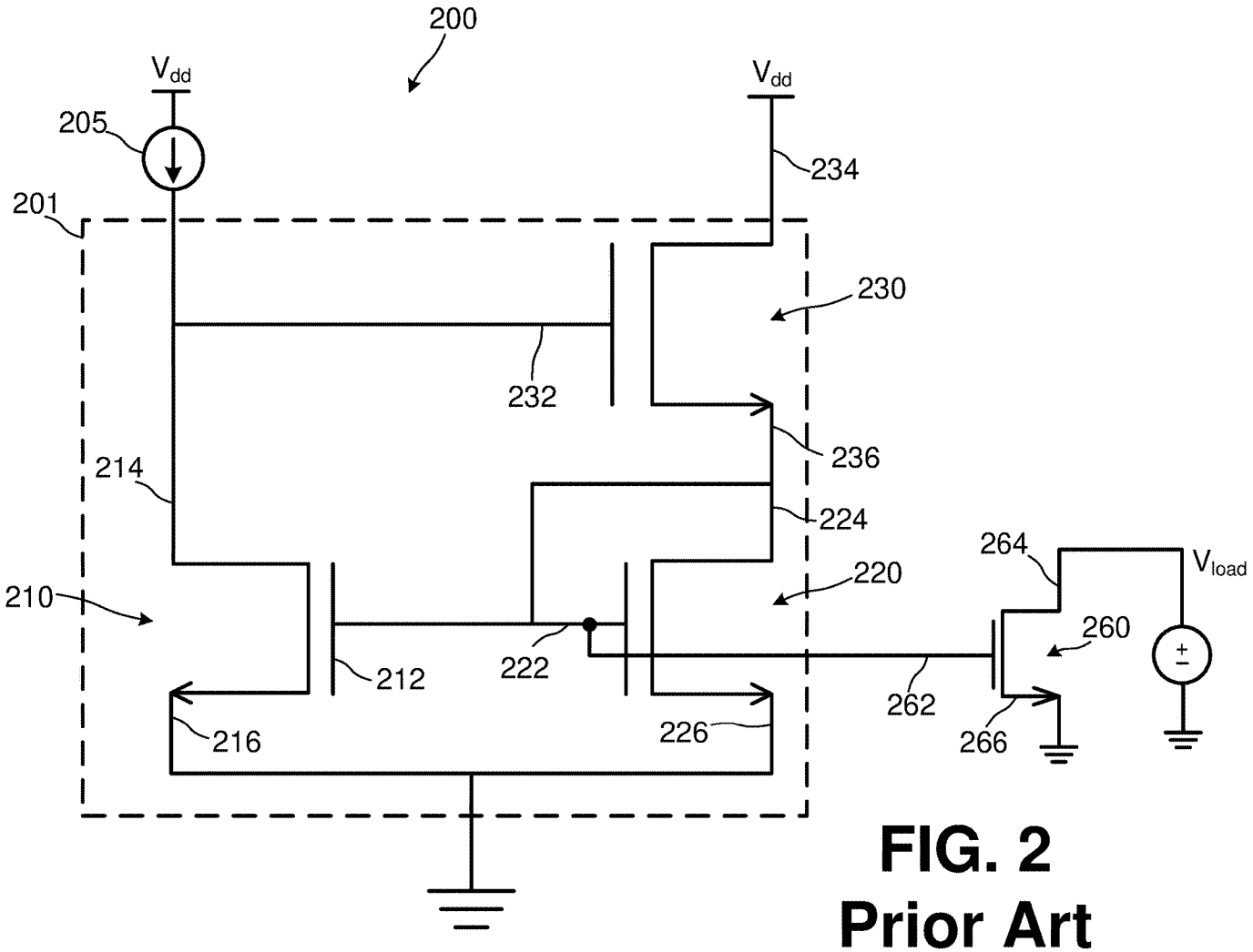
FIG. 2 Prior Art
FIG. 2 is a circuit diagram illustrating a second example of a circuit that implements a prior current mirror.

In the example, the circuit 300 also includes an output device 360 such as, for example, a sixth transistor 360 that has a gate 362, a drain 364, and a source 366 that is electrically coupled to ground. The output device is generally a large output device, e.g., requiring a current of at least 200 uA. The gates 312, 322, and 362 of the first, second, and sixth transistors 310, 320, and 360, respectively, are electrically coupled with each other. The input voltage to the circuit 300 is $V_{dd}$ and the output voltage at the drain 364 of the sixth transistor 360 is $V_{load}$. The voltage of the current mirror input portion 301 at the drain 314 of the first transistor 310 is $V_{gs}$, thus demonstrating the headroom improvement as compared to the circuit 200 of FIG. 2.

Figure 4:
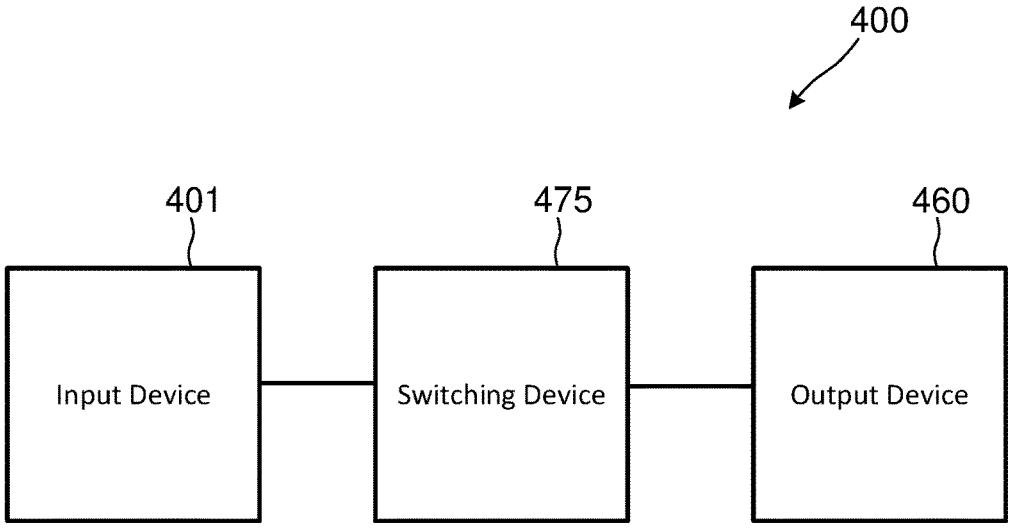
FIG. 4 is a block diagram illustrating a second example of a circuit implementing a current mirror in accordance with certain embodiments of the disclosed technology.

FIG. 4 illustrates a second example of a circuit 400 implementing a current mirror 401 in accordance with certain embodiments of the disclosed technology. In the example, the circuit 400 includes an input device 401, such as the current mirror 301 illustrated by FIG. 3. The circuit 400 also includes an output device 460, such as the sixth transistor 360 illustrated by FIG. 3.

In the example, the circuit 400 also includes a switching device 475 that is electrically coupled between the input device 401 and the output device 460. The switching device 475 may include a transmission gate switch, or any other suitable device, e.g., to provide dynamic switching. In certain embodiments, the switching device 475 may include a resistor or otherwise implement circuitry for resistive damping, e.g., for stability.

Certain implementations of the disclosed technology are directed to circuits and systems in which a relatively small current reference, e.g., 1 uA, can be mirrored to a relatively large bias current, e.g., 200 uA, which can be dynamically switched on and off. Such circuit designs may implement a static reference device and a gate switch for the output device to switch on quickly.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Also, when reference is made in this application to a method having two or more defined steps or operations, the defined steps or operations can be carried out in any order or simultaneously, unless the context excludes those possibilities.

Furthermore, the term "comprises" and its grammatical equivalents are used in this disclosure to mean that other components, features, steps, processes, operations, etc. are optionally present. For example, an article "comprising" or "which comprises" components A, B, and C can contain only components A, B, and C, or it can contain components A, B, and C along with one or more other components.

Also, directions such as "right" and "left" are used for convenience and in reference to the diagrams provided in figures. But the disclosed subject matter may have a number of orientations in actual use or in different implementations. Thus, a feature that is vertical, horizontal, to the right, or to the left in the figures may not have that same orientation or direction in all implementations.

Although specific embodiments of the invention have been illustrated and described for purposes of illustration, it will be understood that various modifications may be made without departing from the spirit and scope of the invention. Accordingly, the invention should not be limited except as by the appended claims.

The invention claimed is:

1. A circuit having a low mirror input voltage and fast settling while providing a large current mirror gain, the circuit comprising:

a first current mirror device having a first transistor and a second transistor, each transistor having a source, a gate, and a drain, wherein the gate of the first transistor is electrically coupled with the gate and drain of the second transistor, and wherein the source of the first transistor and the source of the second transistor are both electrically coupled to ground;

a third transistor having a source, a gate, and a drain, wherein the gate of the third transistor is electrically coupled with the drain of the first transistor;

a second current mirror device having a fourth transistor and a fifth transistor, each transistor having a source, a gate, and a drain, wherein the gate and drain of the fourth transistor are electrically coupled with the gate of the fifth transistor and the drain of the third transistor, wherein the drain of the fifth transistor is electrically coupled with the gate of the first transistor and the gate and drain of the second transistor, and further wherein the source of the fourth transistor and the source of the fifth transistor are both electrically coupled with an input voltage; and a current source electrically coupled with the drain of the first transistor and the gate of the third transistor.

2. The circuit of claim 1, further comprising an output device electrically coupled with the gates of the first and second transistors.

3. The circuit of claim 2, wherein the output device is a sixth transistor.

4. The circuit of claim 2, further comprising a switching device coupled between the output device and the gates of the first and second transistors.

5. The circuit of claim 4, wherein the switching device is configured to dynamically switch between on and off.

6. The circuit of claim 1, wherein the source of the third transistor is electrically coupled to ground.

7. The circuit of claim 2, wherein the current source is configured to provide a current of approximately 1 uA.

8. The circuit of claim 7, wherein the output device is configured to receive a current of approximately 200 uA.

9. The circuit of claim 4, wherein the switching device includes a dampening resistor.

10. The circuit of claim 1, wherein the first and second transistors are metal-oxide-semiconductor, field-effect transistors (MOSFETs).

11. The circuit of claim 1, wherein the third transistor is a metal-oxide-semiconductor, field-effect transistor (MOSFET).

12. The circuit of claim 1, wherein the fourth and fifth transistors are metal-oxide-semiconductor, field-effect transistors (MOSFETs).

13. The circuit of claim 3, wherein the sixth transistor is a metal-oxide-semiconductor, field-effect transistor (MOSFET).

14. The circuit of claim 1, wherein the third transistor is configured to serve as a common source amplifier.

15. The circuit of claim 14, wherein the second transistor is configured to serve as a bias device for the third transistor.

16. The circuit of claim 4, wherein the switching device is a gate switch.

* * * * *